United States Patent [19]

Held

[11] 3,977,120

[45] Aug. 31, 1976

[54] TOY ROCKET GLIDER

[76] Inventor: Hans Held, 8121 Wessobrunn-Haid, Germany

[22] Filed: Oct. 31, 1974

[21] Appl. No.: 522,705

[30] Foreign Application Priority Data

Nov. 2, 1973 Germany ..... 2354966

[52] U.S. Cl. ..... 46/74 R; 46/76 A

[51] Int. Cl.[2] ..... A63H 27/06

[58] Field of Search ..... 46/74 R, 76 R, 76 A, 46/79, 81

[56] References Cited

UNITED STATES PATENTS

| | | | |
|---|---|---|---|
| 2,398,391 | 4/1946 | Orkin | 46/76 A |
| 2,588,184 | 3/1952 | Walsh | 46/74 A |
| 3,246,425 | 4/1966 | Miller | 46/79 |
| 3,613,296 | 10/1971 | Green | 46/76 A |

*Primary Examiner*—Russell R. Kinsey
*Assistant Examiner*—Robert F. Cutting
*Attorney, Agent, or Firm*—Michael J. Striker

[57] ABSTRACT

A delta winged toy rocket glider has improved stability in both powered and gliding flight. The glider has an ejectable rocket mounted forward of and above its center of gravity and a stabilizing surface extending transversely of and symmetrically to the longitudinal axis of the aircraft which is exposed to the action of the rocket propulsion gases. An upwardly extending elevator is provided on the trailing edge of the stabilizing surface as well as on the trailing edges of the wings.

10 Claims, 5 Drawing Figures

TOY ROCKET GLIDER

The invention relates to a toy rocket glider with a delta wing, a so-called tail-less aircraft, which is characterized in that there is provided at a distance above the center of gravity of the aircraft and within the said aircraft the open rear end of a rocket tube for the insertion of a rocket which automatically ejects on cut-off and further characterized by the provision at a distance behind and below the center of gravity of the aircraft of a stabilizing surface extending transversely and symmetrically to the longitudinal axis of the aircraft and being exposed to the action of the rocket propulsion gases, the trailing edge of the said stabilizing surface as well as the trailing edge of the delta wing being upwardly extended as permanent elevators in the sense of applying slight nose heaviness to the aircraft to provide the automatic stabilization in power flight and gliding flight.

In order to limit the action of the elevators and therefore the climbing angle of the flight path the stabilizing surface at the fuselage end is constructed as a lifting or airfoil surface.

Mounting the stabilizing surface under the main wing surface plane of the delta wing permits direct air blowing on the surface for cooling purposes during the burning period of the flight. The stabilizing surface is constructed as a lifting profile surface so that the action of the upwardly extending trailing edge and the climbing angle of the flight path is limited.

To obtain the maximum possible directional stability combined with stabilization of the aircraft about its transverse axis, the wing ends of the delta wings are downwardly curved with a slight negative angle according to a further essential feature of the invention. This simultaneously achieves elevator and rudder control action. To this end, the downwardly curved wing ends or dynamic pressure corners provide dynamic pressure against air vortices around the wing tips.

It is advantageous to protect the stabilizing surface by means of a metal covering against the heat of the discharging rocket propulsion gases.

It is an object of this invention to provide a toy rocket glider having improved stability in both powered and gliding flight.

It is a further object of this invention to provide a toy rocket glider having improved stability about its transverse axis.

It is yet another object of this invention to provide a toy rocket glider having improved stability in both powered and gliding flight by placing the rocket above and forward of the center of gravity and providing a control surface behind and below the center of gravity of the glider upon which the propulsion gases from the rocket act.

It is a still further object of the invention to provide toy rocket glider having improved stability about its transverse axis by the use of delta wings having dynamic pressure corners formed by downwardly extending wing tips.

The invention is illustrated in the accompanying drawing, in which.

Figure 2:
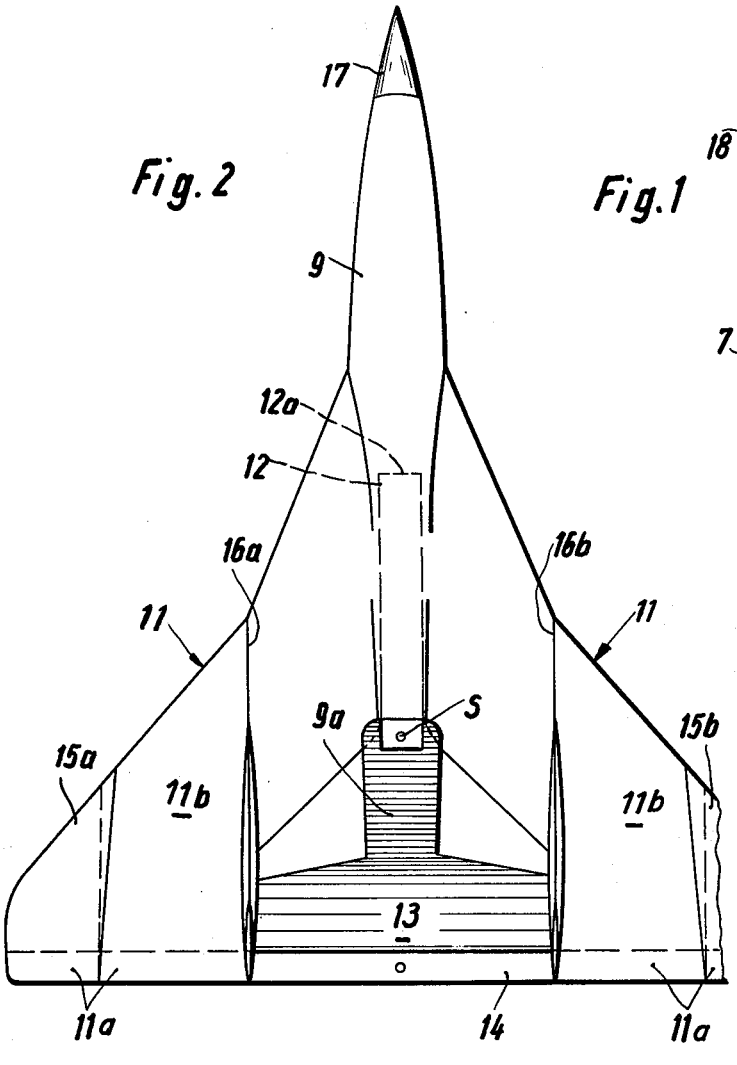
FIG. 2 is a plane view of the rocket glider according to FIG. 1.
Figure 1:
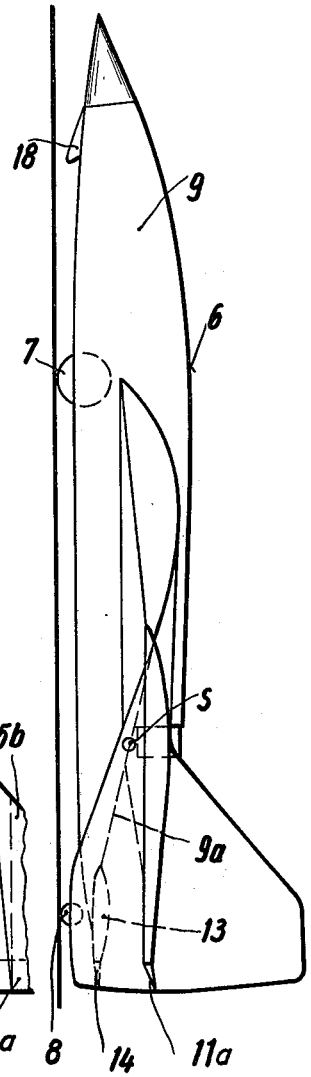
FIG. 1 is a toy rocket glider according to the invention as a side view.
Figure 3:
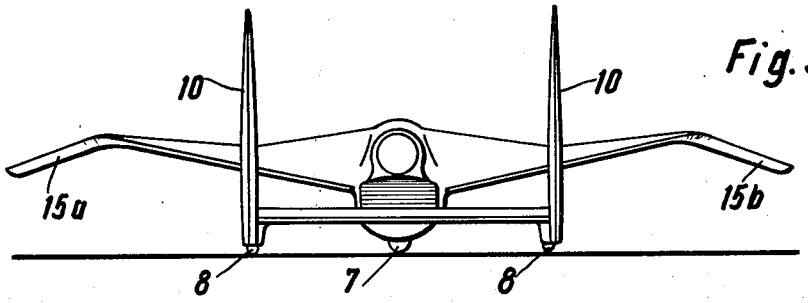
FIG. 3 is a rear view of the rocket glider according to FIG. 2.

FIGS. 1 to 3 show a toy rocket glider 6 which is supported on a front wheel 7 and two rear wheels 8 with a soft running surface as a protection against damage to the fuselage 9 when landing in rough terrain and perpendicular stabilizing surfaces or rudders 10. The fuselage 9 merges into a delta wing surface 11 which continues on the outsides of the rudders 10 and merges into a horizontal trailing edge **11*a*** which is perpendicular to the longitudinal axis of the rocket glider, is upwardly extended and therefore forms a permanent elevator.

Figure 4:
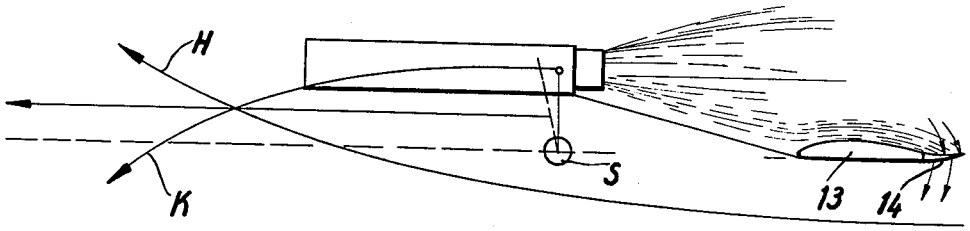
FIG. 4 is a diagram explaining the forces which act in flight of the toy rocket glider according to FIGS. 1 to 3 and FIG. 5 is a diagrammatic view of the flight path of the toy rocket glider.

The center of gravity S is situated in the region of the rear third of the length of the rocket glider. The end of a rocket tube 12 extends within the fuselage and has a closed front end **12*a*, and a rear open end situated above the center of gravity. The rocket tube is constructed to receive a known rocket which is not shown but comprises an unglued paper sleeve with an incombustible nozzle insert inserted into the rear end, the front end being open so that the rocket is automatically ejected from the rocket tube by the propulsion gases acting on the closed end 12*a* of the rocket tube when the propellant is ultimately consumed. FIG. 4 shows that the rocket drive is situated at a high position in relation to the center of gravity which causes a force to be applied to the fuselage which thrusts the nose of the rocket glider downwardly about the center of gravity S. The fuselage end 9*a* disposed behind the rocket tube 12 is reinforced and protected with duraluminum and merges into a stabilizing surface 13 which is lower than the plane of the delta wing 11 and whose trailing edge extends below and parallel to the trailing edge 11*a*** of the delta wing.

The wing tips **15*a*, 15*b*** of the delta wing are downwardly curved with a slight negative angle to form so-called dynamic pressure corners, i.e. they provide dynamic pressure against air vortex formation around the wing tips due to the incoming air so that they also provide an elevator and rudder action to ensure the maximum possible directional stability combined with stabilization of the aircraft about its transverse axis.

The wings **11*b*, outboard of rudders 10 are detachably inserted in the fuselage 9 by means of a tongue-and-groove connection in order to substantially avoid damage from crash landings when colliding with obstructions. The parting line between the fuselage and the detachable wings is designated with the numerals 16*a* or 16*b* and extends on the outside of the vertical stabilizing surfaces 10.**

For safety reasons, the fuselage tip 17 is constructed of soft plastic material and can be inserted as a separate component in a front opening of the fuselage. A starting hook 18 for the insertion into a loop of a rubber pull tape is provided immediately behind the fuselage tip on the underside of the fuselage, the other end of the said rubber tape being secured on a post at a substantial distance in front of the rocket glider so that the rubber tape functions as starting aid when the rocket glider is launched and only a very short runway is required for launching the aircraft.

Figure 5:
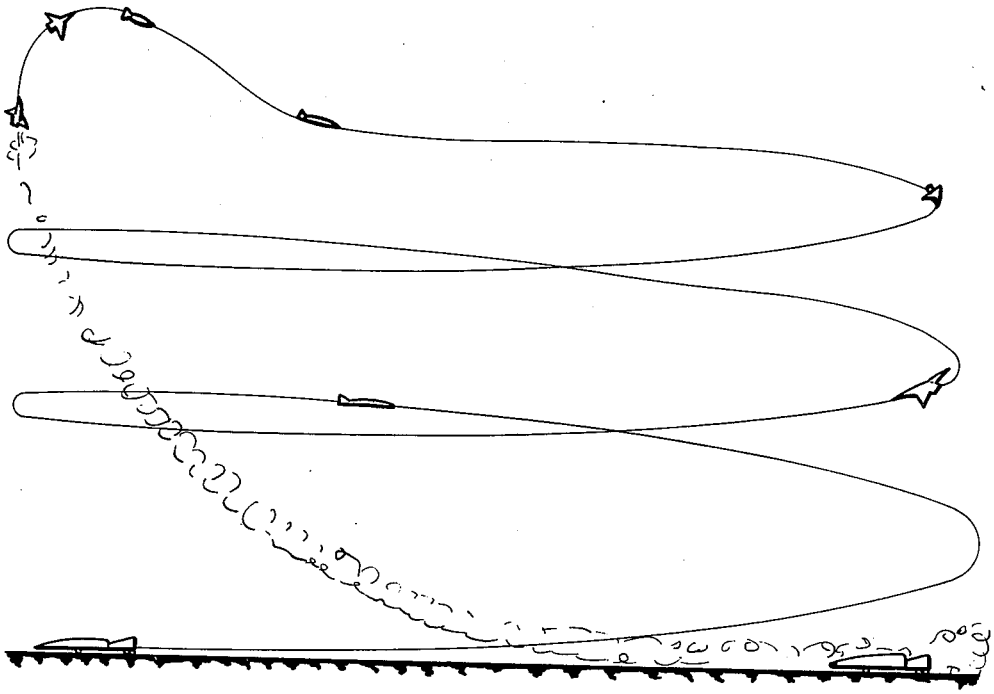

FIG. 4 shows that the main weight of the rocket is situated in front of the center of gravity of the aircraft so that the resultant increased nose heaviness in the direction of the arrow K requires an oppositely orientated force, whose direction is indicated by the arrow H, which is applied by the rocket propellant gases acting on the stabilizing surface 13 and its upwardly extended trailing edge 14. The compact gas stream which strikes the metal-protected stabilizing surface 13 at a lower position therefore achieves adequate control during launching even at a relatively low flying speeds. The rocket disposed above the center of gravity S also stabilizes the flight path so that the risk of an excessively steep attitude of the aircraft due to the action of the elevator and the accompanying risk of increasing speed loss and rupture of the supporting air flow is prevented. The thrust provided by the drive in the direction of an inclined flight path together with an increasing speed results in increased effectiveness of the elevators so that the flight path remains stable (FIG. 5).

The stabilized horizontal flight path changes with increasing speed into the desired rapid climbing flight as the thrust of the driving rocket increases the flying speed. The increased flow velocity of the air through which the aircraft passes causes increased air flow to act on the elevators whose action is limited by the stabilizing surface 13 at a lower position.

The rocket is automatically ejected on propellant cut-off of the rocket drive. Then owing to the top heaviness of the aircraft, the fuselage tip drops from the climbing flight position because the flying speed is substantially decelerated by the large angle of attack of the wings without the thrust. The aircraft then resumes flight, the elevators becoming effective in gliding in accordance with the flying speed to the extent adequate for balanced hovering. The rocket glider therefore returns safely to the ground by gliding in several flight spirals.

It will therefore be seen that the invention ensures automatic stabilization of the rocket glider in power flight and in gliding.

Having described my invention, I claim:

1. A rocket-powered glider of the type which during rocket-propelled flight climbs and which subsequent to the termination of rocket propulsion performs a gliding descent, comprising a fuselage having a center of gravity and a nose; a rocket outlet positioned on the fuselage so that, during at least the initial portion of climbing flight, said rocket outlet is located higher than the center of gravity to thereby exert upon the fuselage a first force tending to turn said nose downwards; and stabilizing means on said fuselage operative during but not after rocket-propelled climbing for exerting upon said fuselage a second force tending to turn said nose upwards, said stabilizing means comprising a stabilizing lifting member located rearwardly of said rocket outlet in the path of rocket exhaust gases so positioned and configurated that rocket exhaust gases impinge upon the stabilizing lifting member causing the latter to exert said second force during but not after rocket-propelled climbing, whereby when rocket burning terminates said second force decreases and permits gliding descent to begin.

2. A glider as defined in claim 1, wherein said stabilizing lifting member has a wing-shaped leading portion and an upwardly-extending trailing portion.

3. A glider as defined in claim 1, wherein said stabilizing lifting member is located lower than the center of gravity during at least the initial portion of climbing flight.

4. A glider as defined in claim 1, wherein said fuselage further comprises delta-type wings, and wherein said stabilizing lifting member is located lower than said delta-type wings during at least the initial portion of climbing flight.

5. A glider as defined in claim 4, wherein said delta-type wings have an upwardly extending trailing portion.

6. A glider as defined in claim 4, wherein said delta-type wings have end portions which curve downwardly with a negative angle.

7. A glider as defined in claim 1; and further comprising protective means for protecting said stabilizing lifting member from the heat of the rocket exhaust gases.

8. A glider as defined in claim 7, wherein said protective means comprises a metallic shield covering said stabilizing lifting member.

9. A glider as defined in claim 1, wherein said fuselage has a predetermined length, and wherein said center of gravity is located in the rear third of said predetermined length.

10. A glider as defined in claim 1, wherein said nose is constituted of soft plastic material.

* * * * *